US006812893B2

(12) United States Patent
Waterman

(10) Patent No.: US 6,812,893 B2
(45) Date of Patent: Nov. 2, 2004

(54) HORIZONTALLY POLARIZED ENDFIRE ARRAY

(75) Inventor: Timothy G. Waterman, Eldersburg, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 43 days.

(21) Appl. No.: 10/391,788

(22) Filed: Mar. 20, 2003

(65) Prior Publication Data

US 2003/0197647 A1 Oct. 23, 2003

Related U.S. Application Data

(60) Provisional application No. 60/371,128, filed on Apr. 10, 2002.

(51) Int. Cl.[7] ..... H01Q 1/38

(52) U.S. Cl. ..... 343/700 MS; 343/850; 343/853

(58) Field of Search ..... 343/700 MS, 767, 343/770, 757, 850, 876, 893; H01Q 1/38

(56) References Cited

U.S. PATENT DOCUMENTS 4,054,874 A 10/1977 Oltman, Jr. ..... 343/700 MS
4,414,550 A 11/1983 Tresselt ..... 343/700 MS
5,926,137 A * 7/1999 Nealy ..... 343/700 MS
6,501,426 B2 12/2002 Waterman ..... 343/700 MS
2001/0007446 A1 7/2001 Amano ..... 343/860
2002/0163469 A1 * 11/2002 Waterman ..... 343/700 MS

* cited by examiner

*Primary Examiner*—Don Wong
*Assistant Examiner*—Trinh Vo Dinh
(74) *Attorney, Agent, or Firm*—Birch, Stewart, Kolasch and Birch, LLP

(57) ABSTRACT

A horizontally polarized end fire antenna array providing 360° scanning over a ground plane including a plurality of radiating cavity backed slots formed by a plurality of mutually separated flat, segments of metallization arranged in a grid and supported by a layer of dielectric material in a coplanar arrangement above and shorted to the ground plane. The side edges of the metallic segments define a plurality of substantially linear crossed slots running in at least two, e.g. orthogonal, directions. Each element of the array consists of four or more adjacent metallized segments having mutually opposing inner corners surrounding a common feed point. RF launch points for the array are formed across the slots of pairs of neighboring segments by conductor elements connected to respective common feed points. Two floating parasitic conducting elements are located in and around the area where the slots cross so as to make the array operate more effectively and comprise a crossed segment of metallization fabricated on the surface of the dielectric layer and a loop of metallization embedded in the center of the dielectric layer beneath the crossed segment.

35 Claims, 7 Drawing Sheets

FIG. 9
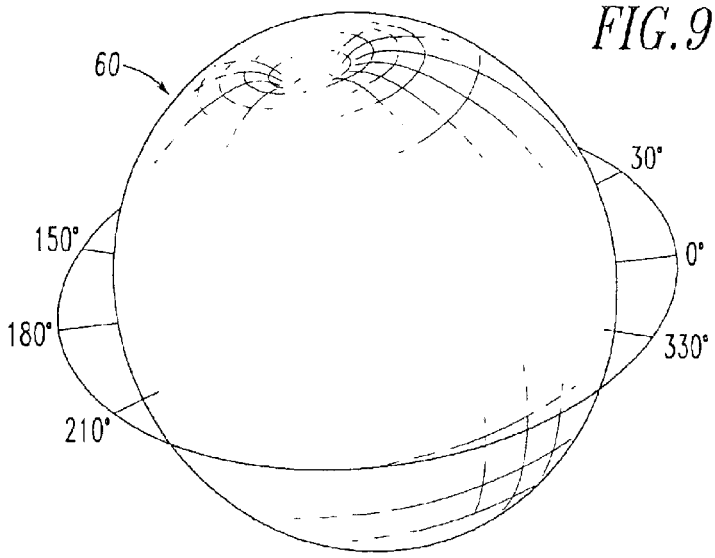
FIG. 10
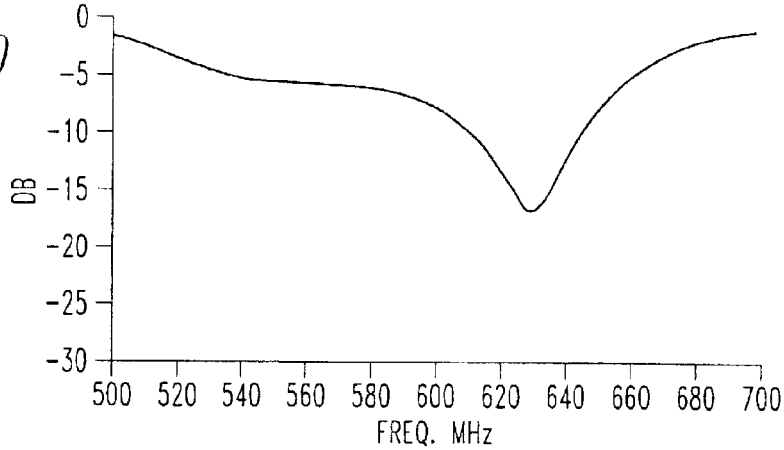
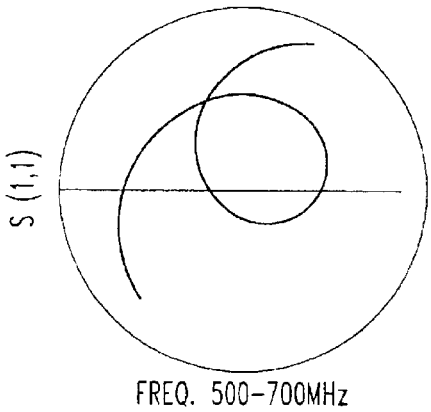
FIG. 11

HORIZONTALLY POLARIZED ENDFIRE ARRAY

REFERENCE TO RELATED APPLICATION

This application is a Non-Provisional application claiming the benefit under 35 U.S.C. § 1.19(e) of U.S. Provisional Application Ser. No. 60/371,128, filed Apr. 10, 2002, the entire contents of which are meant to be incorporated herein by reference.

BACKGROUND OF THE INVENTION

1. Field of the Invention

This invention relates generally to RF antennas operating a microwave frequencies and more particularly to a horizontally endfire array of crossed slot radiating elements.

2. Description of Related Art

Endfire antenna arrays for radiating electromagnetic energy coplanar with a ground plane at microwave frequencies are generally known. One such antenna is shown and described, for example, in U.S. Pat. No. 6,501,426, entitled "Wide Scan Angle Circularly Polarized Array", issued to Timothy G. Waterman, the present inventor, on Dec. 31, 2002. Disclosed therein is an array of dual trough radiator elements including orthogonally crossed trough waveguide cavities and RF feed members of predetermined adjustable length extending across the cavities from one radiator element to its neighbor. Feed members are suspended in a slot formed in the body of the radiator elements and the inner or proximal ends are connectable to an RF source via a feed point, while the outer or distal end is open circuited. The array also includes intermediate support members of electrical insulation located on the outer surface of the radiator element and a parasitic ground plane consisting of a set of parasitic conductor elements is located on the top surface of the intermediate support members so as to enable scanning of the array to or near endfire when energized.

SUMMARY OF THE INVENTION

In one aspect, the present invention is directed to a horizontally polarized endfire antenna array providing 360° scanning over a ground plane and comprised of a plurality of radiating cavity backed slots formed by a plurality of mutually separated flat, typically rectangular or triangular, segments of metallization arranged in a grid and supported by a layer of dielectric material in a coplanar arrangement above the ground plane. The metallic segments are shorted to the ground plane at their centers. The side edges of the metallic segments define a plurality of substantially linear crossed slots running in at least two, e.g. orthogonal, directions. Each element of the array consists of a plurality, four or more, of adjacent metallized segments having mutually opposing inner corners surrounding a common feed point. RF launch points for the array are formed across the slots of pairs of neighboring segments by elongated electrically insulated launch point conductor elements connected to respective common feed points and running beneath the segments and extending open circuited across a respective slot at their midpoints.

In a further aspect of the invention, two floating parasitic conducting elements are located in and around the area where the slots cross so as to make the array operate more effectively and comprise a crossed segment of metallization fabricated on the surface of the dielectric layer and a loop of metallization embedded in the center of the dielectric layer beneath the crossed segment.

Yet another aspect of the invention is directed to a method of providing a horizontally polarized endfire radiation pattern, comprising the steps of arranging an array of radiator elements in a grid, wherein each of said radiator elements is comprised of a plurality of flat segments of metallization having side edges defining a predetermined number of crossed cavity backed slots and mutually opposing inner corners; locating the segments above a ground plane; shorting each of said flat segments to the ground plane; generating a plurality of launch points for contributing field vectors at each segment of metallization of said radiator elements from a respective common RF feed point located at at least two crossed slots of said predetermined number of crossed cavity backed slots and surrounded by said mutually opposing inner corners of said plurality of segments of the respective radiator element, by extending respective feed members extending across the slots from one segment of said plurality of segments of metallization to an immediate adjacent segment of each of said radiator elements for generating said launch points and connecting a same one end of said feed members of each of said radiator elements to said common RF feed point and leaving the other end open circuited.

Further scope of applicability of the present invention will become apparent from the detailed description provided hereinafter. It should be understood, however, that the detailed description and specific examples, while illustrating the preferred embodiments of the invention, they are given by way of illustration only, since various changes and modifications coming within the spirit and scope of the invention will become apparent to those skilled in the art from the detailed description.

BRIEF DESCRIPTION OF THE DRAWINGS

The present invention will become more fully understood from the detailed description provided hereinafter in the accompanying drawings, which are not necessarily to scale, and are provided by way of illustration only and accordingly are not meant to be considered in a limiting sense, and wherein:

FIG. 9 is illustrative of an antenna pattern generated by a single antenna element of the embodiments of the invention;

FIG. 10 is a characteristic curve illustrative of the return loss for each antenna element of the subject invention;

FIG. 11 is a Smith chart plot of the return loss shown in FIG. 10;

DETAILED DESCRIPTION OF THE INVENTION

Figure 1:
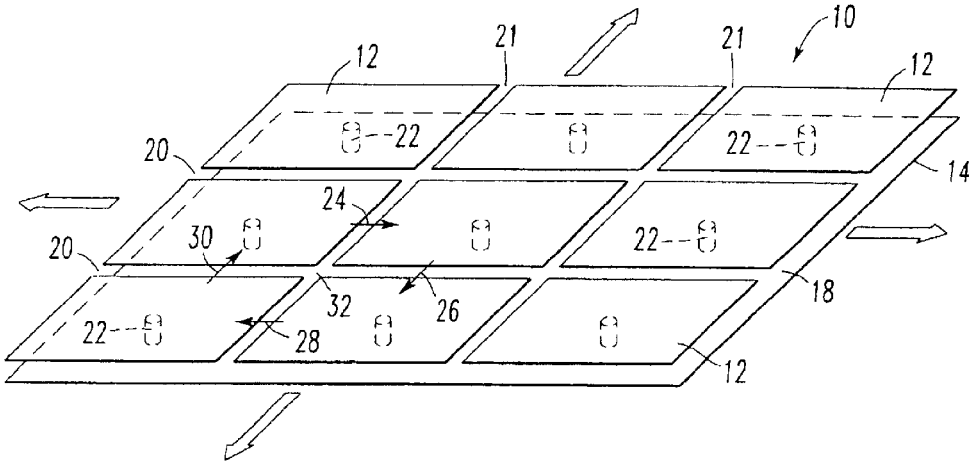
FIG. 1 is a perspective planar view readily illustrative of a preferred embodiment of an endfire array in accordance with the subject invention.

Referring now to the figures wherein like reference numerals refer to like components, reference is first made collectively to FIGS. 1–4 which depict the first embodiment of the invention. Shown thereat is a horizontally polarized endfire array that is capable of radiating RF energy at endfire in the plane of an array 10 of mutually separated square rectangular planar segments of metallization 10 arranged in a grid and located in a coplanar arrangement above a ground plane 14. The metalllized segments 12 are supported above the ground plane 14 by a flat piece of dielectric material 16 shown in FIG. 4 so as to provide a cavity shown by reference numeral 18. The metal segments 12 are arranged in an orthogonal grid and their side edges define a plurality of orthogonal cavity backed slots 20 and 21. The metallized segments 12 are also shown short circuited to the ground plane 14 by centralized shorting elements 22. In such an arrangement, the crossed slots are capable of radiating horizontal polarization at endfire in the plane of the grid of antenna segments 12 and the ground plane 14 when RF energy is applied to the array 10.

The array 10 has a thickness which is less than $\lambda/20$ where $\lambda$ is the wavelength of the RF energy to be radiated. With such a dimension, the cavity backed slots 20 and 21 are capable of radiating horizontal polarization at endfire without the necessity of a parasitic ground plane, and, moreover, can be located near (less than $\lambda/8$) away from a large conducting member such as a sheet that would normally prohibit efficient propagation. The bandwidth of the array 10 is a function of the cavity thickness ($\lambda/20$) shown in FIG. 4 and the number of elements in the endfire array. An array 10, for example, having a thickness of $0.05\lambda$ and including several hundred elements arranged in a square or disc have a bandwidth in the order of about 10%. For wider bands, the thickness of the array can be increased. Accordingly, usable bandwidth can be traded off against thickness in the number of elements that are utilized and can function without the need of a parasitic ground plane, which normally would reside between $\lambda/4$ and $\lambda/2$ above the conducting surface and therefore can be made extremely thin.

In the embodiment of the invention shown in FIGS. 1–4, a horizontally polarized RF field pattern is generated by a feed mechanism for each element, i.e., four segments 12 having four mutually opposing inner corners that drives four positions shown by the vectors 24, 26, 28 and 30 (FIGS. 1 and 2) around the intersection of two slots 20 and 21 as shown by reference numeral 32. The vectors 24 . . . 30 can either be oriented clockwise as shown, or counterclockwise. If it is not done in this fashion, there will be blind spots generated in the azimuth radiation pattern.

Figure 3:
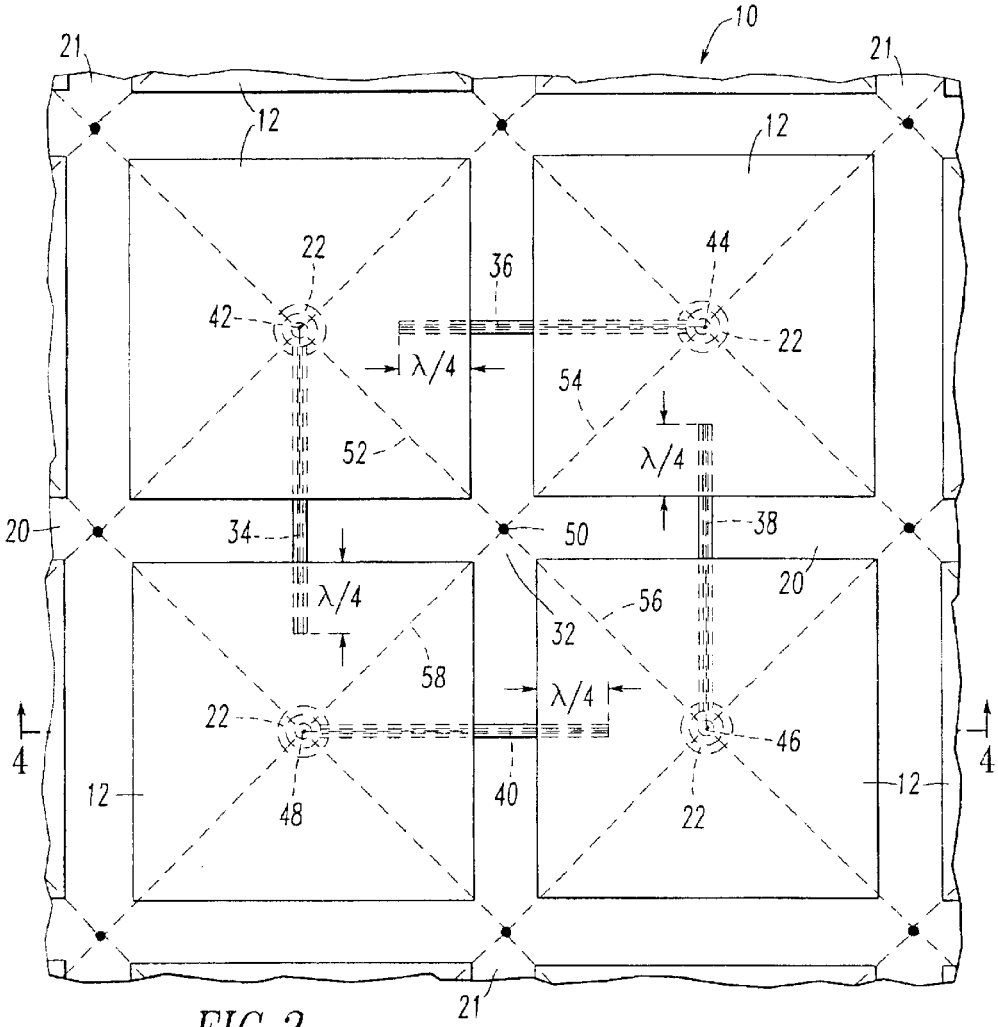
FIG. 3 is a top planar view further illustrative of the antenna element shown in FIG. 2.

The four field vectors 24, 26, 28 and 30 for four respective drive points are, furthermore, shown located midway along the side edges of the square segments 12. The field vectors 24, 26, 28 and 30 are generated by elongated electrically insulated conductor elements 34, 36, 38 and 40, as shown in FIG. 3, which cross the slots 20 and 21 beneath the radiator segments 12, and being connected to respective electrically insulated conductors 42, 44, 46 and 48 formed within the shorting elements 22 where they are connected to a common feedpoint 50 for each array element via conductors 52, 54, 56 and 58 which run beneath the ground plane 14 and are adjacent outer combiner element 15. Further as shown in FIG. 3, the launch point conductors 34,36, 38 and 40 in addition to crossing the slots 20 and 21, also extend open circuited beneath an immediate adjacent or neighboring segment by a distance of $\lambda/4$ as shown.

Figure 2:
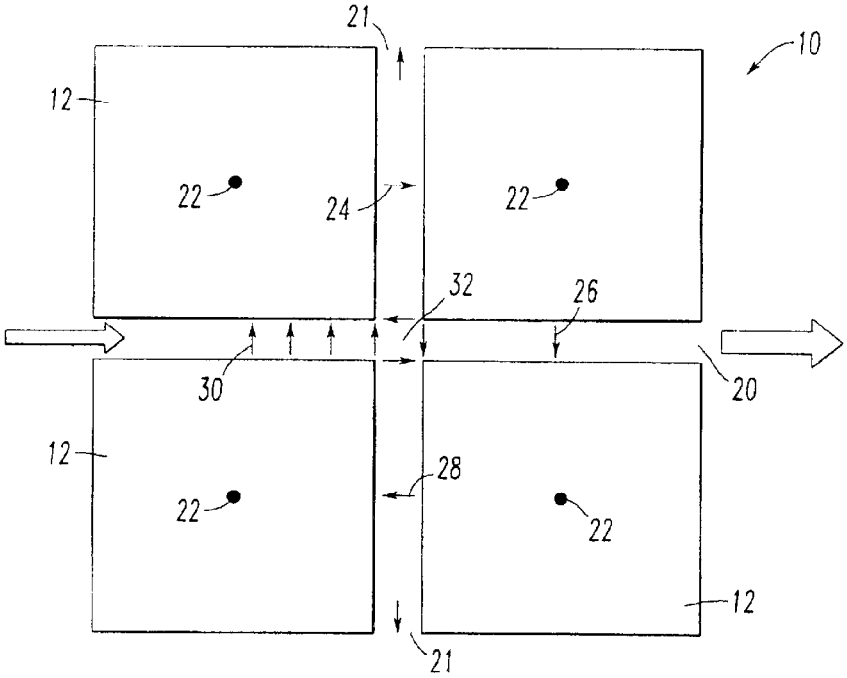
FIG. 2 is a top planar view illustrative of one antenna element of the array shown in FIG. 1.

Further, as shown in FIG. 2, the four contributing field vectors 24, 26, 28, and 30 from the four launch points generated by the slot crossing conductor elements 34, 36, 38, and 40, are all out of phase when they reach the center to cross at the intersection 32. This causes a straight up null, broadside to the array of the radiation pattern as shown in FIG. 9 by reference numeral 60, which is desired radiation at endfire. It can be seen that a field vector traveling left to right in FIG. 2 tends to cross the slot with 180° phase shift and at constructively out of the opposite end. However, there is a tendency for that particular vector not to travel vertically because it is shorted out by the fields that are present there which is desirable. The concept of the endfire operation is that once a field is launched in a particular direction, it is desirable that it continue on unimpeded and contribute to the far field pattern, not shown.

Figure 4:
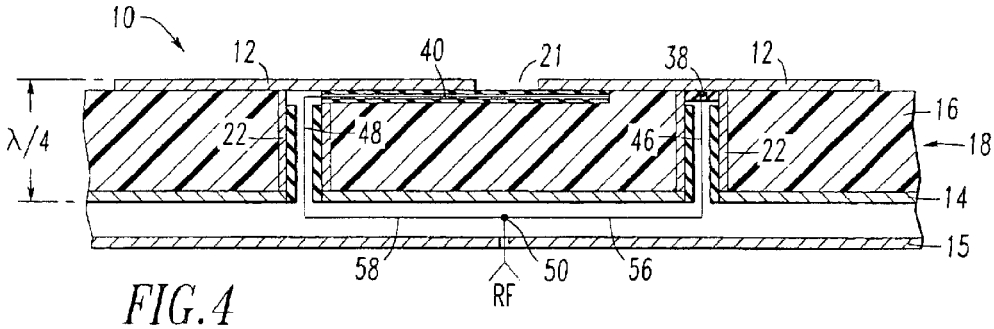
FIG. 4 is a partial transverse section of the antenna element shown in FIG. 3 taken along the lines 4—4 thereof.
Figure 5A:
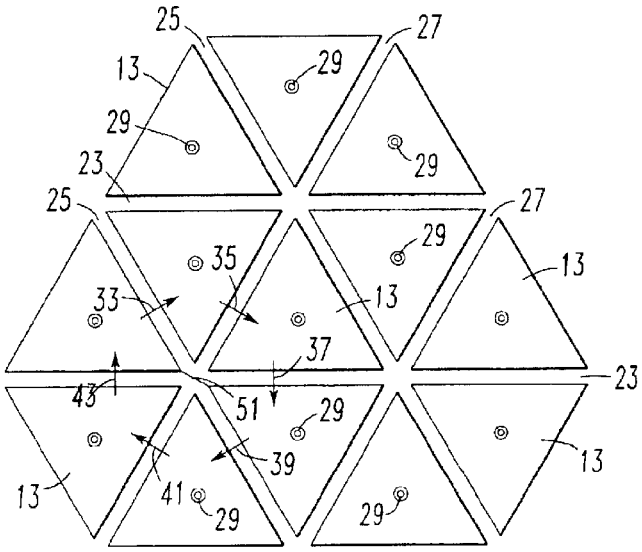
FIGS. 5A and 5B are top planar and side planar views of a second preferred embodiment of the invention.
Figure 5B:
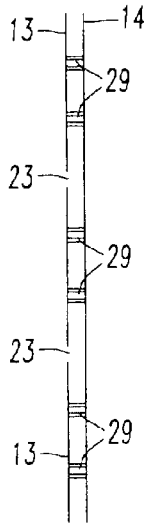

While the embodiment shown in FIGS. 1 through 4 depicts a square orthogonal grid, it should be noted that, when desirable, other geometrical shapes of the segments could be utilized, forming, for example, a triangular grid as shown in FIGS. 5A and 5B where triangular shaped segments 13 are utilized and separated by slots 23, 25 and 27 which are oriented at an angle of 60° with respect to one another. Reference numeral 29 represents the shorting members extending from respective centers of the triangular shaped segments 13 to a ground plane 14. With a triangular configuration of antenna segments 13, six field vectors 33, 35, 37 . . . 43 are required around the intersection of three slots 23, 25 and 27 as shown by reference numeral 51 in order to obtain 360° of endfire coverage. The feed mechanism for the configuration shown in FIG. 5A is the same as illustrated in FIGS. 3 and 4 for the square grid embodiment of the invention but modified for six segments 13 per array element having six mutually opposing inner corners.

FIGS. 10 and 11 are illustrative of the return loss per element of the array shown in FIGS. 1–4 where one element of the array comprises four rectangular antenna segments 12 as shown in FIG. 2. FIG. 10 comprises a conventional rectilinear plot of loss vs. frequency, whereas FIG. 11 represents a Smith chart of the return loss per element. The return loss is shown to be less than −6.0dB over approximately a 16° frequency band. The anticipated bandwidth for medium sized arrays is about 10%.

Figure 6:
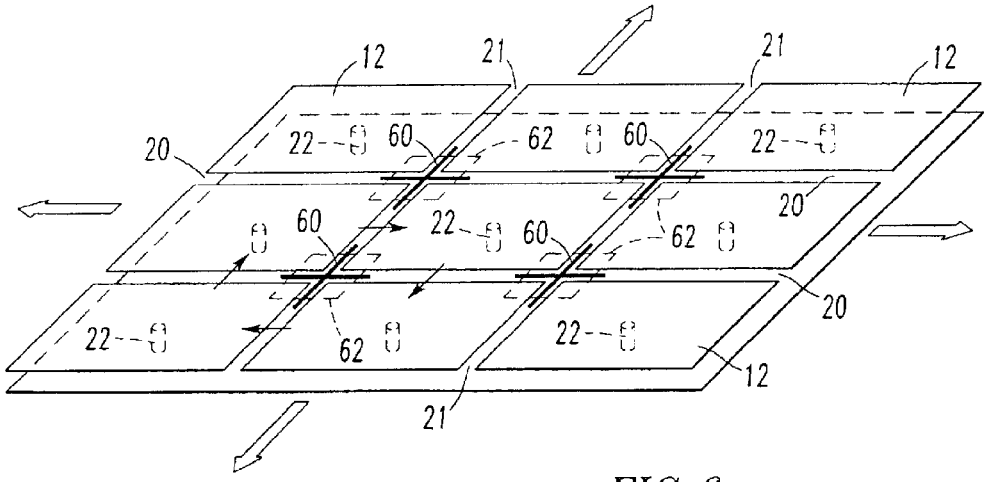
FIG. 6 is a perspective elevational view of a third embodiment of the invention similar to that shown in FIG. 1.
Figure 7:
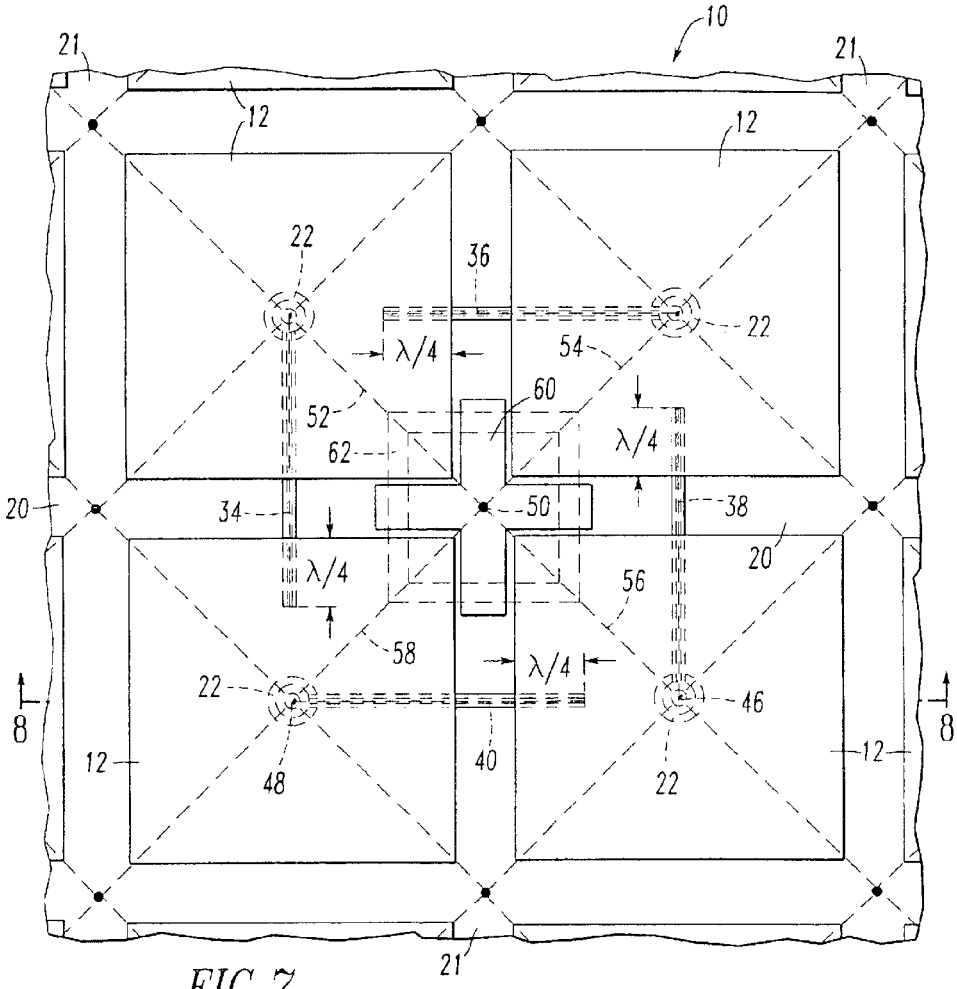
FIG. 7 is a top planar view further illustrative of one element of the array shown in FIG. 6.
Figure 8:
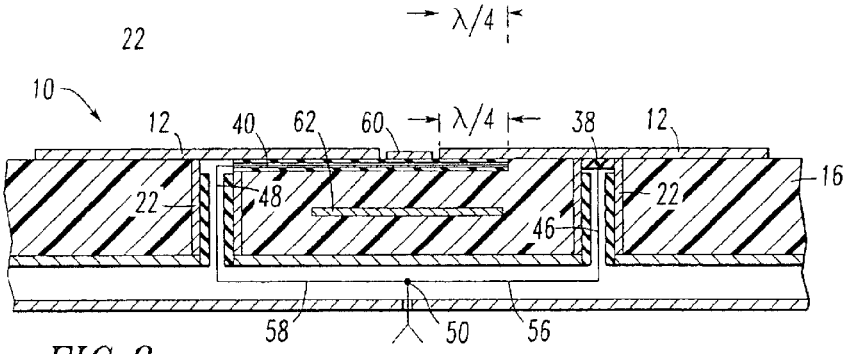
FIG. 8 is a transverse sectional diagram of the antenna element shown in FIG. 7 and taken along the lines 8—8 thereof.
Figure 12:
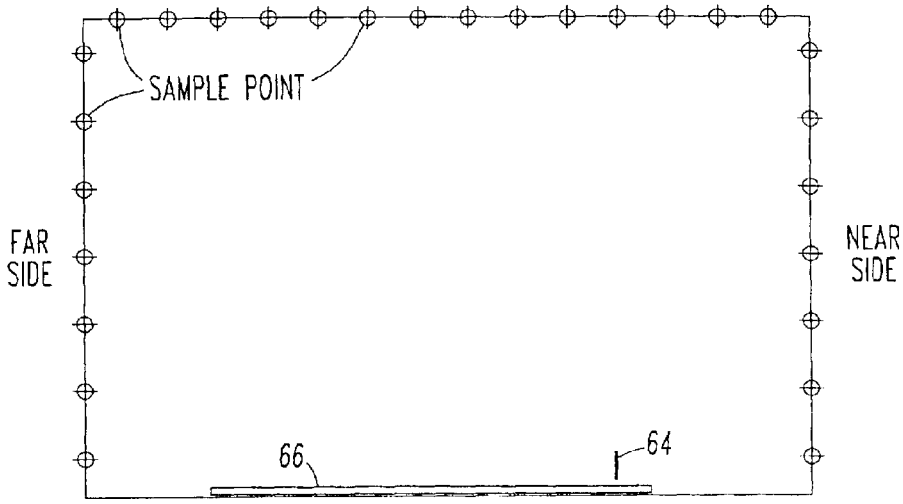
FIG. 12 is a diagram illustrative of near field sampling points for a monopole pattern of the subject invention.
Figure 13:
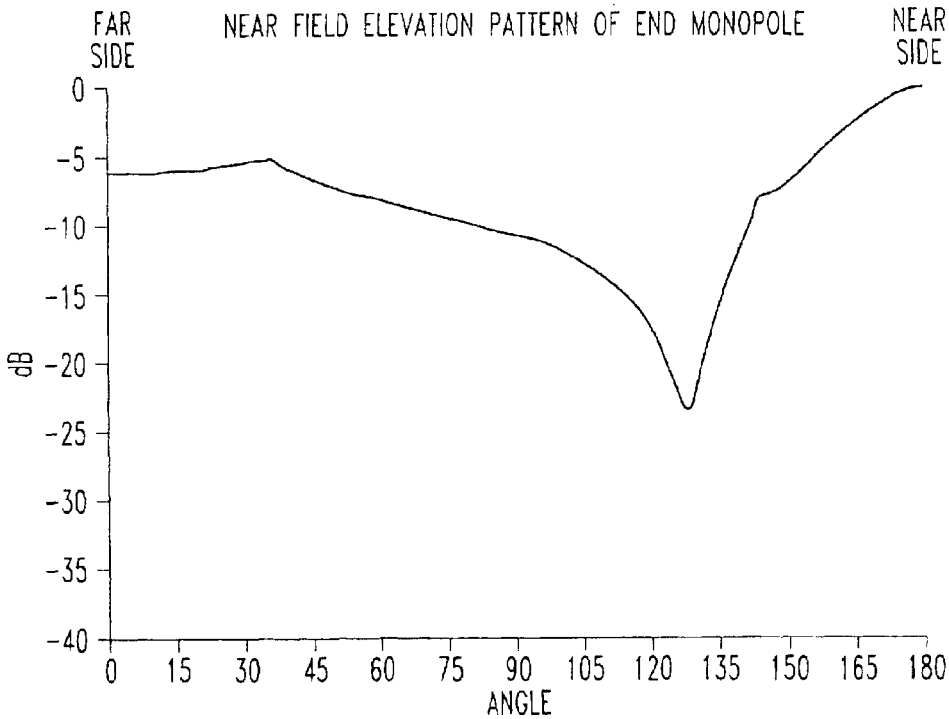
FIG. 13 is illustrative of a near field elevation pattern of a monopole antenna in accordance with the subject invention.

For a horizontally polarized endfire array of cross slots to operate more effectively, the radiation from each element of the array 10 shown, for example, in FIGS. 1–4 needs an unimpeded path to the far field, ignoring any mutual coupling effects. The cross slots 20 and 21 shown thereat produce some attenuation of the radiated RF signal where the slots cross, particularly at the high end of the operating frequency band. The crossing slots 20 and 21 tend to appear more like a choke at the high end of the band. This problem, however, can be eliminated with the addition of two "floating" parasitic conducting elements that are placed in and around the area where the slots cross. Such an implementation is shown in FIGS. 6, 7 and 8 and is similar to the structure shown in FIGS. 1, 3 and 4, but now with the addition of a segment of metallization 60 in the form of a cross formed on the surface of the dielectric layer 16 at the intersections of the slots 20 and 21, and a square loop of metallization 62 embedded in the center of the dielectric layer 16 forming the cavity underlying the metallization 60 and centered around the feedpoint 50 as shown in FIG. 7. The parasitic structures 60 and 62 allow the propagating field to traverse the intersecting slot with relatively little loss. This can be seen with reference to FIGS. 13, 14 and 15. FIG. 12 shows a near field sample space of a vertically polarized monopole 64 over a smooth conducting ground plane 66 which is used for a "finite difference time domain" analysis. The near field elevation pattern of an end monopole shown in FIG. 13 is well known and is the shape wished to be duplicated in the subject invention but with the opposite polarization.

Figure 14:
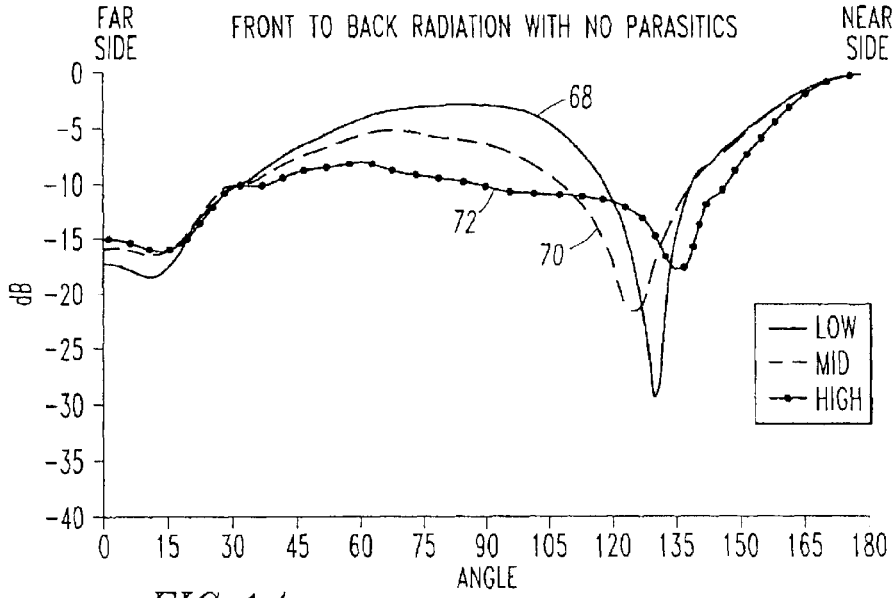
FIG. 14 is illustrative of a front-to-back radiation pattern of a portion of the antenna according to the subject invention for the embodiment shown in FIG. 1.
Figure 15:
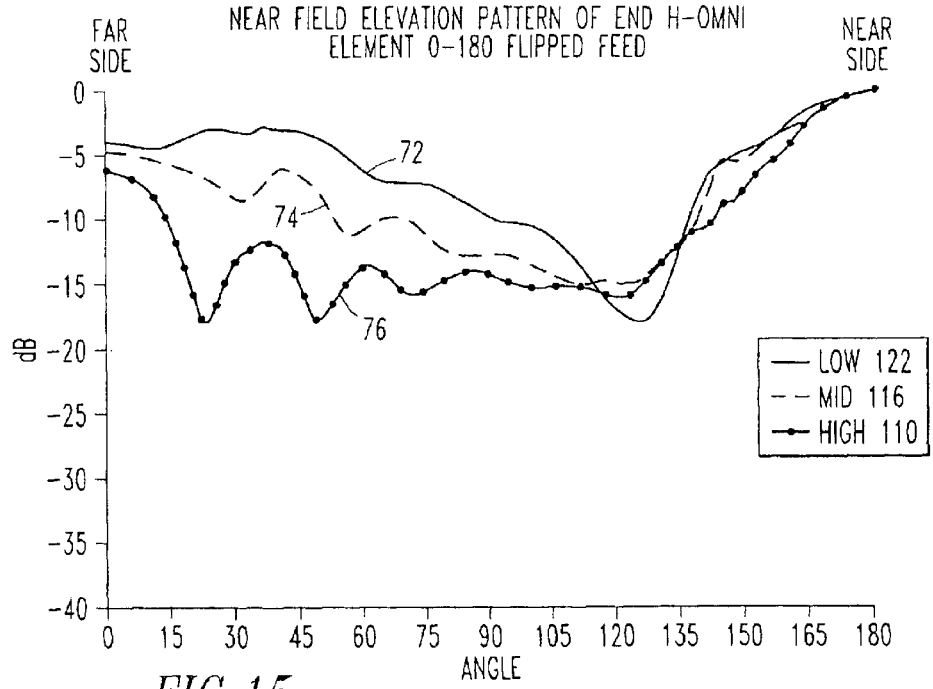
FIG. 15 is a diagram illustrative of the front-to-back radiation pattern of a portion of the embodiment of the invention shown in FIG. 6.

FIG. 14 is illustrative of the near field pattern of the crossed slot configuration shown, for example, in FIGS. 1–4 for three different operating frequencies; low, mid and high, as shown by reference numerals 68, 70 and 72. It can be seen with reference to FIG. 14 that the level of radiation past the ground plane at −180° elevation is about 10 dB lower than that of the monopole at 0° shown in FIG. 13. On the other hand, with the addition of the parasitic elements 60 and 62 as shown in FIG. 7, it can be seen that the gain at the opposite side of the antenna as shown at 0° in FIG. 15 for the near field pattern 72, 74 and 76 for low, mid range and high frequency operating frequencies has been restored to about the −6 dB level, which is the level of unattenuated monopole energy, indicating that the set of floating parasitic elements 60 and 62 when embedded in and around the intersection of slots in an endfire cross slot array, significantly improves the ability of the radiated wave to propagate across the array face. Such an arrangement would provide an improvement of approximately 1.5 dB per slot crossing, thus making feasible very large endfire crossed slot arrays.

The invention being thus described, it would be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An endfire antenna for providing a horizontally polarized radiation pattern, comprising:

an array of radiator elements arranged in a grid, each of said radiator elements being comprised of a plurality of flat segments of metallization having side edges defining a predetermined number of crossed cavity backed slots and mutually opposing inner corners and being located above a ground plane, each said flat segment further having a short circuit connection to the ground plane;

an RF feed circuit providing a plurality of contributing field vectors from respective launch points at each segment of metallization of said radiator elements from a respective common RF feed point located at least two crossed slots of said predetermined number of crossed cavity backed slots and surrounded by said mutually opposing inner corners of said plurality of segments of the respective radiator element, and respective feed members extending across the slots from one segment of said plurality of segments of metallization to an immediate adjacent segment of each of said radiator elements for generating said launch points, and wherein a same one end of said feed members of each of said radiator elements is connected to said common RF feed point and the other end is open circuited.

2. An endfire antenna according to claim 1 wherein the segments of metallization are supported above the ground plane by an intermediate layer of dielectric material.

3. An endfire antenna according to claim 1 wherein said crossed slots comprise orthogonal slots.

4. An endfire antenna according to claim 1 wherein said side edges of said segments of metallization comprise substantially linear edges.

5. An endfire antenna according to claim 1 wherein all of said segments of metallization have a same multi-lateral geometric shape and said short circuit connection to the ground comprises a generally centralized short circuit connection.

6. An endfire antenna according to claim 5 wherein said segments of metallization are rectangular in shape.

7. An endfire antenna according to claim 5 wherein said segments of metallization are square in shape.

8. An endfire antenna according to claim 5 wherein said segments of metallization are triangular in shape.

9. An endfire antenna according to claim 1 wherein said at least two crossed slots comprise multiple pairs of crossed slots and said respective common RF feed point is located at respective crossing points of said pairs of crossed slots.

10. An endfire antenna according to claim 1 and additionally including at least one parasitic conductor element located at the intersection of said crossed slots.

11. An endfire antenna according to claim 10 wherein said at least one parasitic conductor comprises a crossed segment of metallization located between said segments of metallization of said antenna element.

12. An endfire antenna according to claim 11 wherein said segments of metallization are supported above the ground plane by an intermediate layer of dielectric material and wherein said crossed segment of metallization is fabricated on an outer surface of said dielectric layer between said segments of metallization.

13. An endfire antenna according to claim 10 wherein said at least one parasitic conductor comprises a loop of metallization located beneath said segments of metallization at said mutually opposing inner corners.

14. An endfire antenna according to claim 13 wherein said segments of metallization are supported above the ground plane by an intermediate layer of dielectric material and said loop of metallization is embedded in said layer of dielectric material.

15. An endfire antenna according to claim 14 wherein said loop of metallization comprises a generally rectangular loop of metallization.

16. An endfire antenna according to claim 1 and additionally including two floating parasitic conductor elements located at the intersection of said crossed slots.

17. An endfire antenna according to claim 16 wherein one of said two parasitic conductor elements comprises a crossed segment of metallization located between said segments of metallization and the other of said two parasitic conductor elements comprises a loop of metallization located beneath said segments of metallization at said mutually opposing inner corners.

18. An endfire antenna according to claim 17 and additionally including a layer of dielectric material supporting said segments of metallization on said ground plane, wherein said one parasitic conductor element is mounted on an external surface of said layer of dielectric material and said other parasitic conductor element is embedded in said layer of dielectric material.

19. An endfire antenna according to claim 18 wherein all of said segments of metallization have the same geometric shape.

20. An endfire antenna according to claim 19 wherein said short circuit connection comprises a generally centralized short circuit connection of said segments to the ground plane.

21. A method of providing a horizontally polarized endfire radiation pattern, comprising the steps of:

arranging an array of radiator elements in a grid, wherein each of said radiator elements is comprised of a plurality of flat segments of metallization having side edges defining a predetermined number of crossed cavity backed slots and mutually opposing inner corners;

locating the segments above a ground plane;

shorting each of said flat segments to the ground plane;

generating a plurality of launch points for contributing field vectors at each segment of metallization of said radiator elements from a respective common RF feed point located at at least two crossed slots of said predetermined number of crossed cavity backed slots and surrounded by said mutually opposing inner corners of said plurality of segments of the respective radiator element, by extending respective feed members extending across the slots from one segment of said plurality of segments of metallization to an immediate adjacent segment of each of said radiator elements for generating said launch points and connecting a same one end of said feed members of each of said radiator elements to said common RF feed point and leaving the other end open circuited.

22. A method according to claim 21 and additionally including the step of supporting the segments of metallization above the ground plane by an intermediate layer of dielectric material.

23. A method according to claim 21 and additionally including the step of extending the open circuited other end of the feed members about a quarter wavelength past the respective slots.

24. A method according to claim 21 wherein said side edges of said segments of metallization comprise substantially linear edges.

25. A method according to claim 21 wherein all of said segments of metallization have a same multi-lateral geometric shape and wherein said shorting step comprises shorting said segments to the ground substantially at the respective midpoints thereof.

26. A method according to claim 25 wherein said segments of metallization are rectangular in shape.

27. A method according to claim 25 wherein said segments of metallization are square in shape.

28. A method according to claim 25 wherein said segments of metallization are triangular in shape.

29. A method according to claim 21 and additionally including the step of locating at least one parasitic conductor element at the intersection of said crossed slots.

30. A method according to claim 29 wherein said at least one parasitic conductor comprises a crossed segment of metallization located between said segments of metallization of said antenna element.

31. A method according to claim 29 wherein said at least one parasitic conductor comprises a loop of metallization located beneath said segments of metallization at said mutually opposing inner corners.

32. A method according to claim 21 and additionally including the step of locating two floating parasitic conductor elements at the intersection of said crossed slots.

33. A method according to claim 32 wherein one of said two parasitic conductor elements comprises a crossed segment of metallization located between said segments of metallization and the other of said two parasitic conductor elements comprises a loop of metallization located beneath said segments of metallization at said mutually opposing inner corners.

34. A method according to claim 33 and additionally including the steps of supporting said segments of metallization on said ground plane by a layer of dielectric material, mounting said one parasitic conductor element on an external surface of said layer of dielectric material, and embedding said other parasitic conductor element in said layer of dielectric material.

35. A method according to claim 34 wherein all of said segments of metallization have the same geometric shape.

* * * * *